US007913415B2

(12) United States Patent
Goldberg et al.

(10) Patent No.: US 7,913,415 B2
(45) Date of Patent: Mar. 29, 2011

(54) DEVICE FOR DRYING LAUNDRY BY MEANS OF A CURRENT OF AIR

(75) Inventors: Roman Goldberg, Dresden (DE); Kai Nitschmann, Neuenhagen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/593,986

(22) Filed: Nov. 6, 2006

(65) Prior Publication Data

US 2007/0107251 A1 May 17, 2007

(30) Foreign Application Priority Data

Nov. 16, 2005 (DE) ..... 10 2005 054 683

(51) Int. Cl.
*F26B 21/06* (2006.01)
*F26B 19/00* (2006.01)

(52) U.S. Cl. ..... 34/82; 34/85

(58) Field of Classification Search ..... 34/72, 79, 34/82, 85, 595, 603, 604, 140
See application file for complete search history.

(56) References Cited

U.S. PATENT DOCUMENTS

| | | | | |
|---|---|---|---|---|
| 3,979,194 | A * | 9/1976 | Wiser | 55/296 |
| 4,653,200 | A * | 3/1987 | Werner | 34/82 |
| 7,257,905 | B2 * | 8/2007 | Guinibert et al. | 34/82 |

FOREIGN PATENT DOCUMENTS

| | | |
|---|---|---|
| DE | 7117465 U | 10/1972 |
| DE | 82 24 528 U | 2/1983 |
| DE | 44 03 183 | 8/1995 |
| DE | 198 42 644 | 3/2000 |
| EP | 1 050 619 | 11/2000 |
| EP | 1 098 028 | 5/2001 |
| GB | 2 350 416 | 11/2000 |

* cited by examiner

*Primary Examiner* — Jiping Lu
(74) *Attorney, Agent, or Firm* — James E. Howard; Andre Pallapies

(57) ABSTRACT

The device for drying laundry 1 by means of a current of air comprises a drum 2 to accommodate the laundry 1 and a ducting system 4, 5, 6, to direct said current of air. The ducting system 4, 5, 6 has a section 4 arranged downstream of the drum 2, in which the current of air is directed downwards and in which is arranged a filter 8 to capture lint 9 from the current of air. A scraper 15 is assigned to the filter 8, in order to scrape off the lint 9. The receptacle 19, 20 has a handle 21 and two interlinked shell elements (19, 20) which can be separated from each other, and which define a storage volume to accommodate the scraped-off lint (9). According to the invention, lint 9 thus scraped off can be removed from the device and disposed of, without the user needing to come into direct contact with the lint 9.

20 Claims, 11 Drawing Sheets

DEVICE FOR DRYING LAUNDRY BY MEANS OF A CURRENT OF AIR

Figure 1:
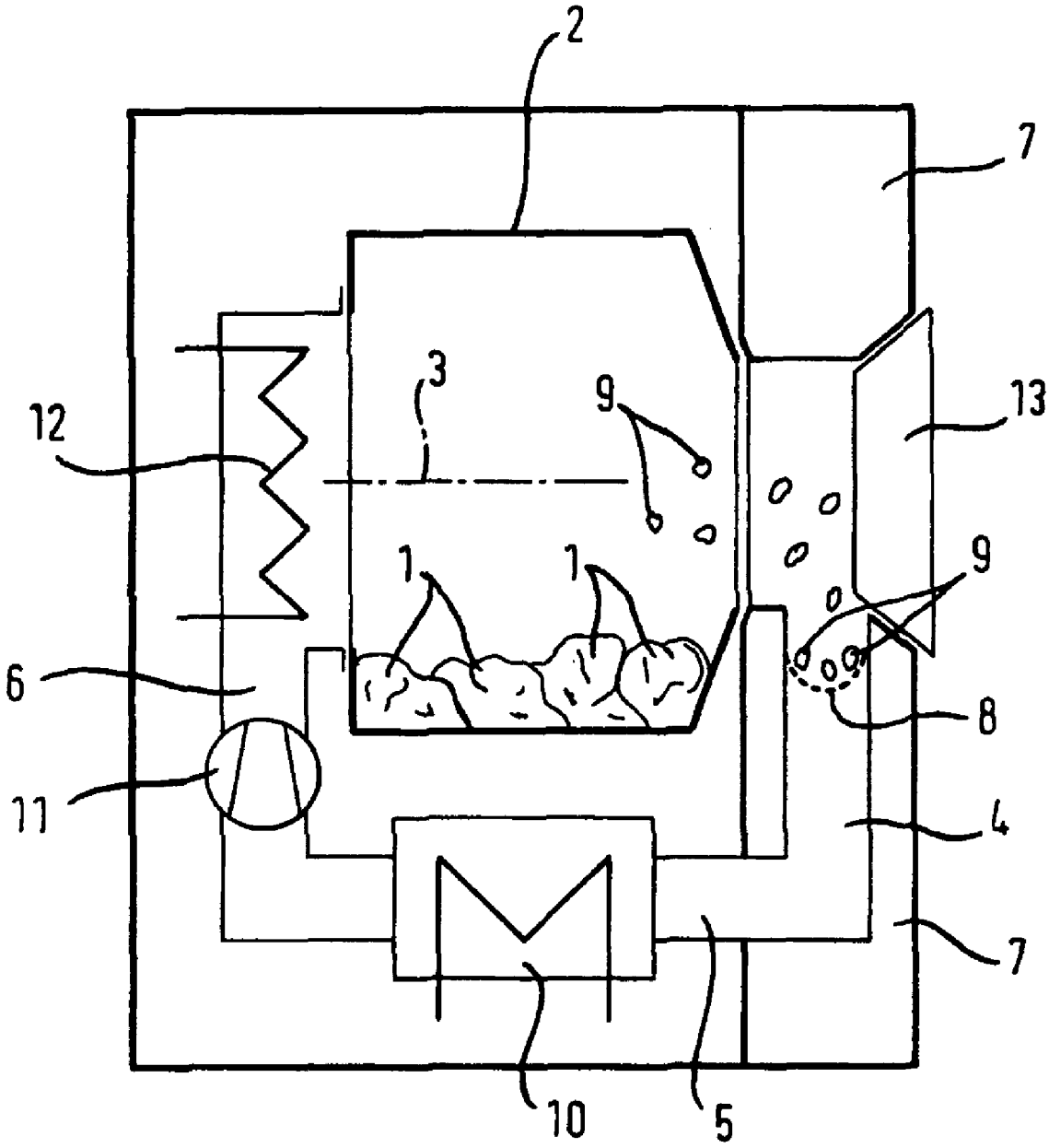

The invention relates to a device for drying laundry by means of a current of air, comprising a drum to accommodate the laundry and a ducting system to direct the current of air, the ducting system having a section arranged on the downstream side of the drum, in which the air current is directed in a downward direction, and within which is located a filter to remove lint from the current of air and a scraper to scrape off lint captured by the filter and a receptacle with an opening to take the lint thus scraped off said filter.

A device of this kind is known from EP 1 050 619 B1 and DE 44 03 183 C2 respectively. The device in accordance with these publications incorporates a flat filter, which serves to catch lint dislodged and conveyed by a current of warmed air during the drying of the laundry, which is agitated in a rotating drum. The lint captured by the filter must be removed at regular intervals, in order that the resistance to the current of air provided by the filter is sufficiently low to prevent the drying of the laundry being impaired. To this end, each device is provided with a scraper, which is periodically actuated, in order to scrape the captured lint from the filter. According to EP 1 050 619 B1, the filter is embodied as part of a continuous belt, and when driven by a motor, can be moved past the fixed scraper with its entire effective length. The lint thereby scraped off the filter is collected in a reservoir. According to DE 44 03 183 C2, the filter is embodied as a fixed surface, and is traversed by a movable scraper in order to remove the lint captured; the scraper is connected to a closure mechanism for the door of the tumble dryer by means of an appropriate transmission, so that the scraper is passed across the filter every time the door is opened. The disclosure of both publications is incorporated by reference herein.

EP 0 997 571 B1 relates to a method for monitoring the current of drying air in a household tumble dryer and a correspondingly developed household tumble dryer. Here, a means to measure and monitor the speed of the stream of drying air is provided for. An undesirably high resistance to the current of air is thus detected and indicated by a suitable alarm. The main cause for such an increase in resistance to the current of air is lint, which is collected in appropriate components of the dryer. According to DE 199 24 297 A1, a household tumble dryer is provided for, with a self-cleaning lint filter, appropriate sensor equipment and a correspondingly developed control device, in order to enable the detection of an unacceptably high level of resistance to the air current at the lint filter during a drying process, and to rectify this by effecting self-cleaning of the lint filter. The disclosure of both publications is incorporated by reference herein.

Each of the devices described in the cited publications EP 1 050 619 B1 and DE 44 03 183 C2 is characterized in that it has systematized the cleaning of the filter through removal of the captured lint, so that impairment of the drying process is largely excluded, and consistently good results from the drying process ensured. No convenient and simple means of removing and disposing of the collected lint yet exist, however.

Accordingly, the invention to be described below is based on the object of creating a device of the type cited in the introduction, which is equipped with a simpler and easy-to-handle means of storing, removal and disposal of the collected lint.

This object is achieved by a device for drying laundry by means of a current of air, comprising a drum to accommodate the laundry and a ducting system to direct the current of air, the ducting system having a section arranged on the downstream side of the drum, in which the air current is directed in a downward direction, and within which is located a filter to remove lint from the current of air and a scraper to scrape off lint captured by the filter and a receptacle with an opening to take the lint thus scraped off said filter, according to the invention the receptacle having a handle and two interlinked shell elements which can be separated from each other, the parts of the shell elements defining a storage volume to accommodate the scraped-off lint.

The invention introduces a lightweight and simply-manufactured receptacle, which accommodates scraped-off lint and which can be removed from the device in one piece using the handle and simply opened for disposal of the collected lint, and closed again after disposal of the lint. A means of preventing the user of said device coming into direct contact with such lint is provided for; the removal of unwanted lint from a device for drying laundry and its simple disposal by means of easy handling procedures are thus ensured.

The parts of the shell elements are preferably connected with each other by a hinge and a snap connection corresponding with said hinge.

Likewise preferably, the device has an end plate, which on one side forms a support structure for a frontal panel of the device and a frontal support for the drum and on the other side bears a door for closure of the drum, the filter and the receptacle being arranged in the end plate. The filter and the receptacle are thus simply and readily accessible and can be easily reached for the routine disposal of lint and for eventual maintenance work.

The receptacle is preferably is connected to the filter via a snap connection, by means of which it can simply and consistently be brought into a prescribed operating position and fixed there for eventual use.

Likewise preferably, the receptacle has a movable pusher, which opens the aperture when the receptacle is located in the operating position to take the scraped-off lint, and which closes said aperture when the receptacle is moved out of the operating position. In this way the loss of lint from the receptacle is prevented if the receptacle is moved out of the operating position for disposal of the lint.

Also preferably, the pusher is guided in first guide tracks, for example such that lugs or cylinders on the pusher engage in these first guide tracks. The first guide tracks are here molded onto the receptacle, for example by means of studs molded onto corresponding surfaces, grooves set into such surfaces or combinations of such studs and such grooves. It is even more preferably the case if such first guide tracks are at least partially aligned in parallel with a vertical, so that a movement of the pusher can be supported by the gravitational force.

Also preferably, guide strips are to be provided, which are non-positively and thus immovably connected with the filter, and each of which engages in a first guide track for positioning of the receptacle. Also preferably, the pusher is here contacted by the guide strips in order to open the aperture, and the aperture closed by the weight of the pusher upon the receptacle being moved out of the operating position. A simple and reliable relationship of effect for release and closure of the aperture is thus provided without any need for an additional source of power source, for example a spring.

Particularly preferable is a device having a flap, which is connected synchronously with the pusher in a movable manner, via a joint, and is guided in second guide tracks which are in each case partially parallel to a first guide track, and molded onto the receptacle, the flap being swung out of the receptacle when the pusher releases the aperture, and swung into the receptacle when the pusher closes the aperture. The above remarks relating to the first guide tracks and the pusher apply to the design of the second guide tracks and guidance of the flap within them. The flap supports the closure of the aperture upon the receptacle being moved out of the operating position, such that it performs a movement directed towards the interior of the receptacle, thus pressing any lint which may be protruding from the aperture into said receptacle. This serves to prevent lint falling out of the receptacle upon removal of the said receptacle, and remaining in the device and clogging any part of the same. Also preferably, the first and second guide tracks are embodied such that the movement of the pushers and the flap is not restricted by the first guide tracks, but by the second guide tracks. Accordingly the first guide tracks are described as being open, the second guide tracks as closed, and in each case as double-sided. This is of particular significance in the case of an embodiment as described above, in which the first serve to latch the receptacle in the operating position; here, guide strips correspondingly provided in the device serve in particular at the same time to contact and move the pushers, when the receptacle is inserted in the operating position.

Particularly preferable is a development of the invention, in which the scraper can be driven by a motor. This achieves fully machine-based removal of lint from the operating process in the device, with the possibility of automation. In combination with the simple and convenient disposal of the lint this gives rise to a device for the drying of laundry which offers a particularly high level of user-friendliness.

Figure 2:
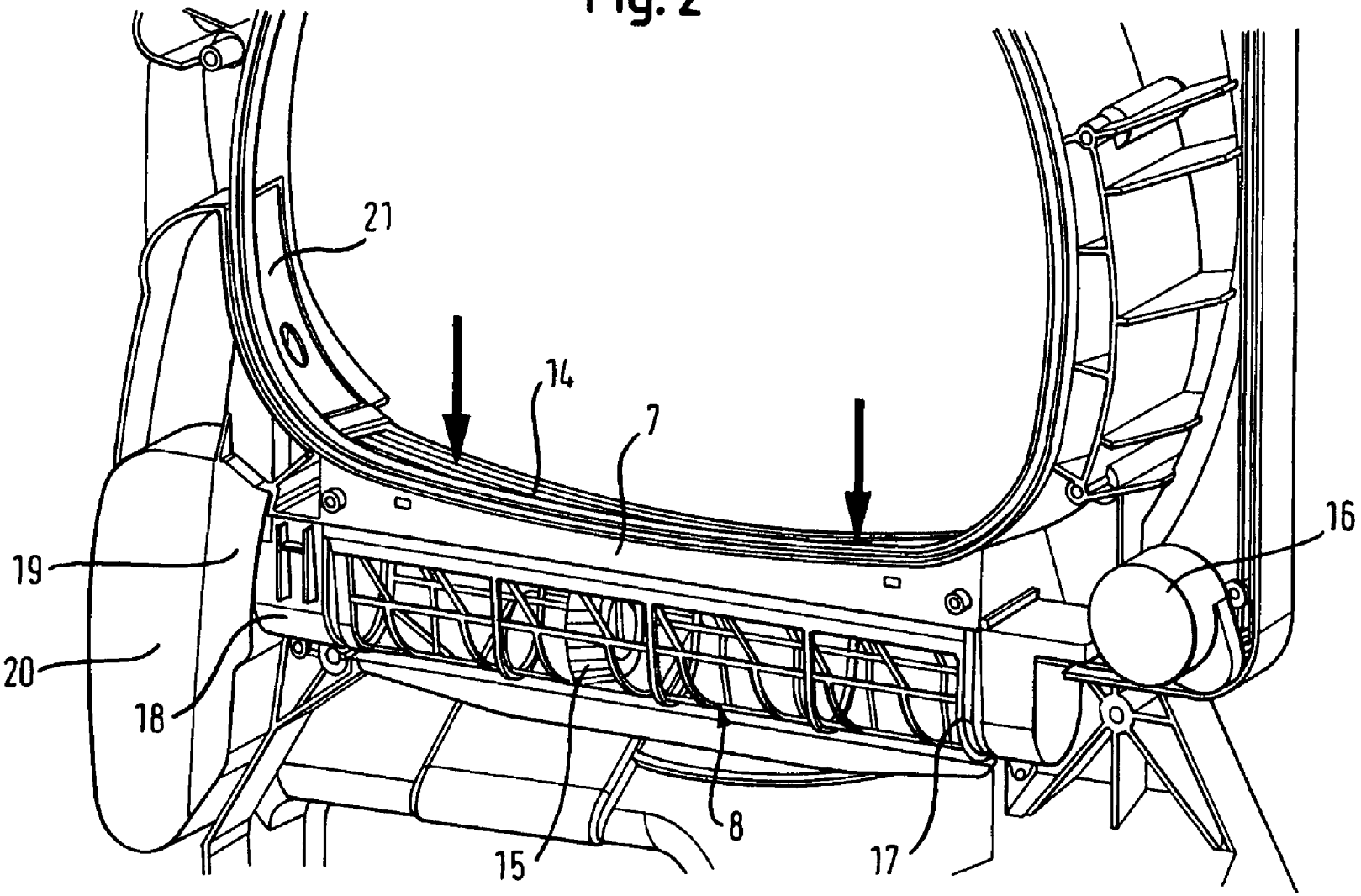
Figure 3:
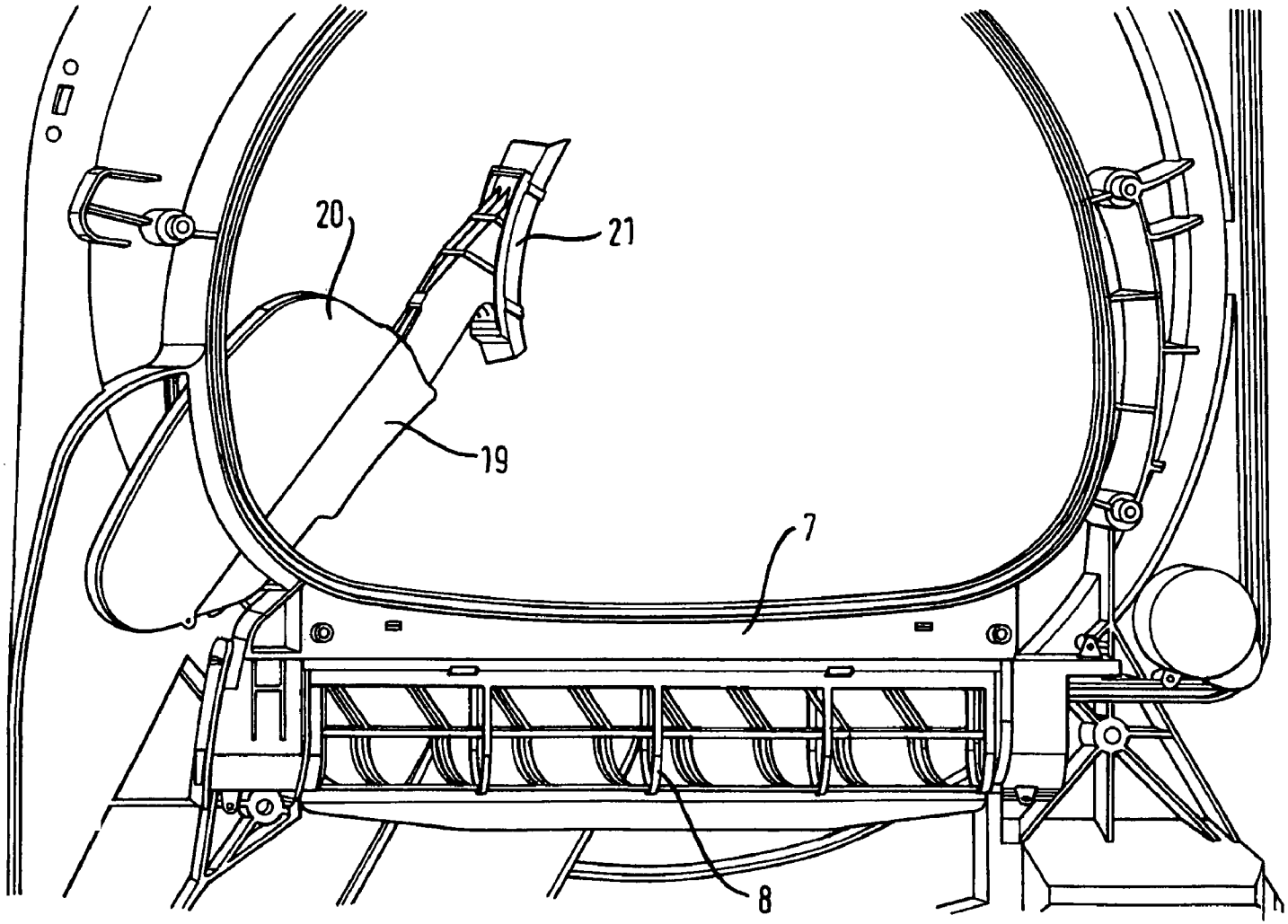
Figure 4:
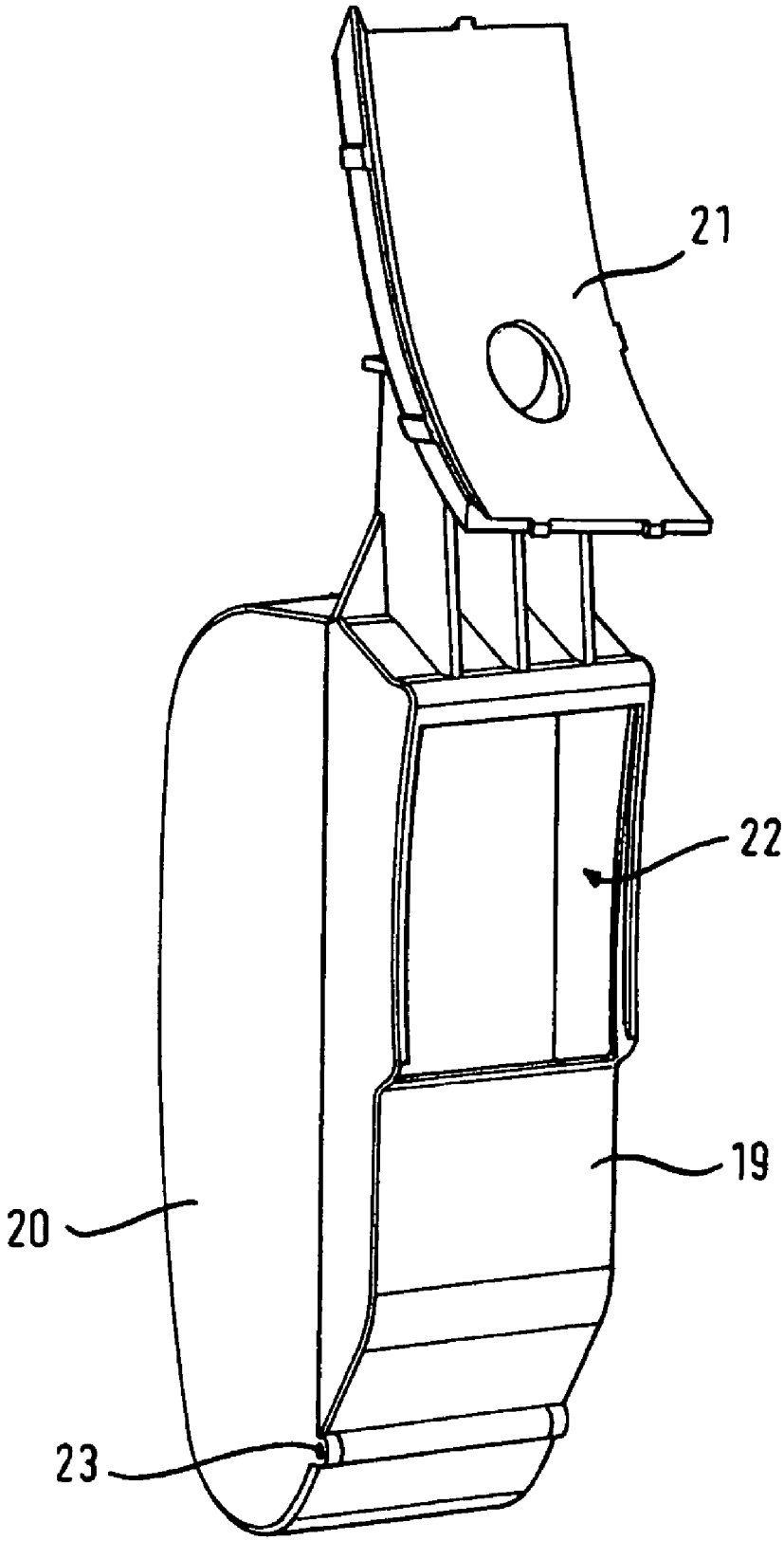
Figure 5:
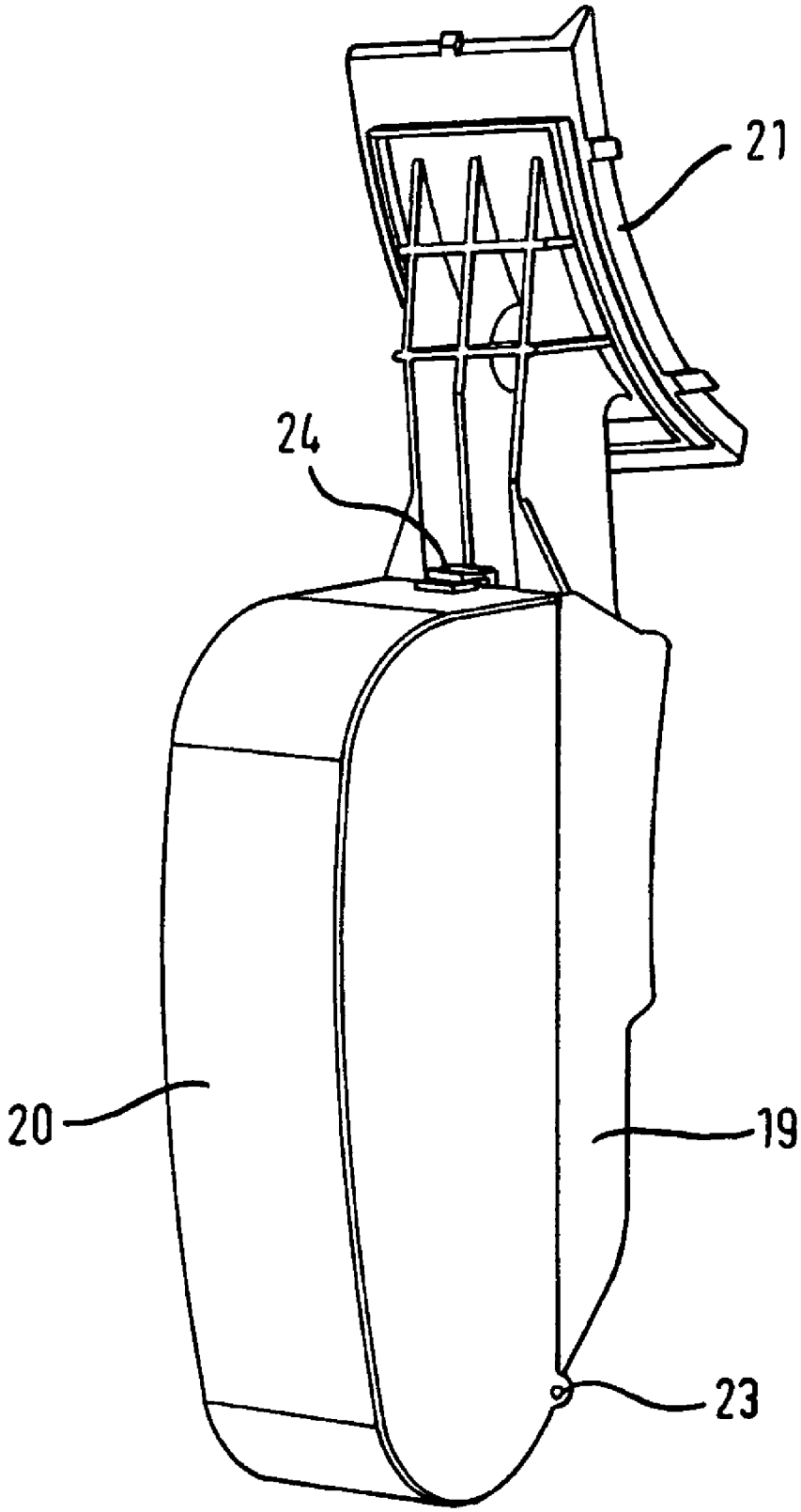
Figure 6:
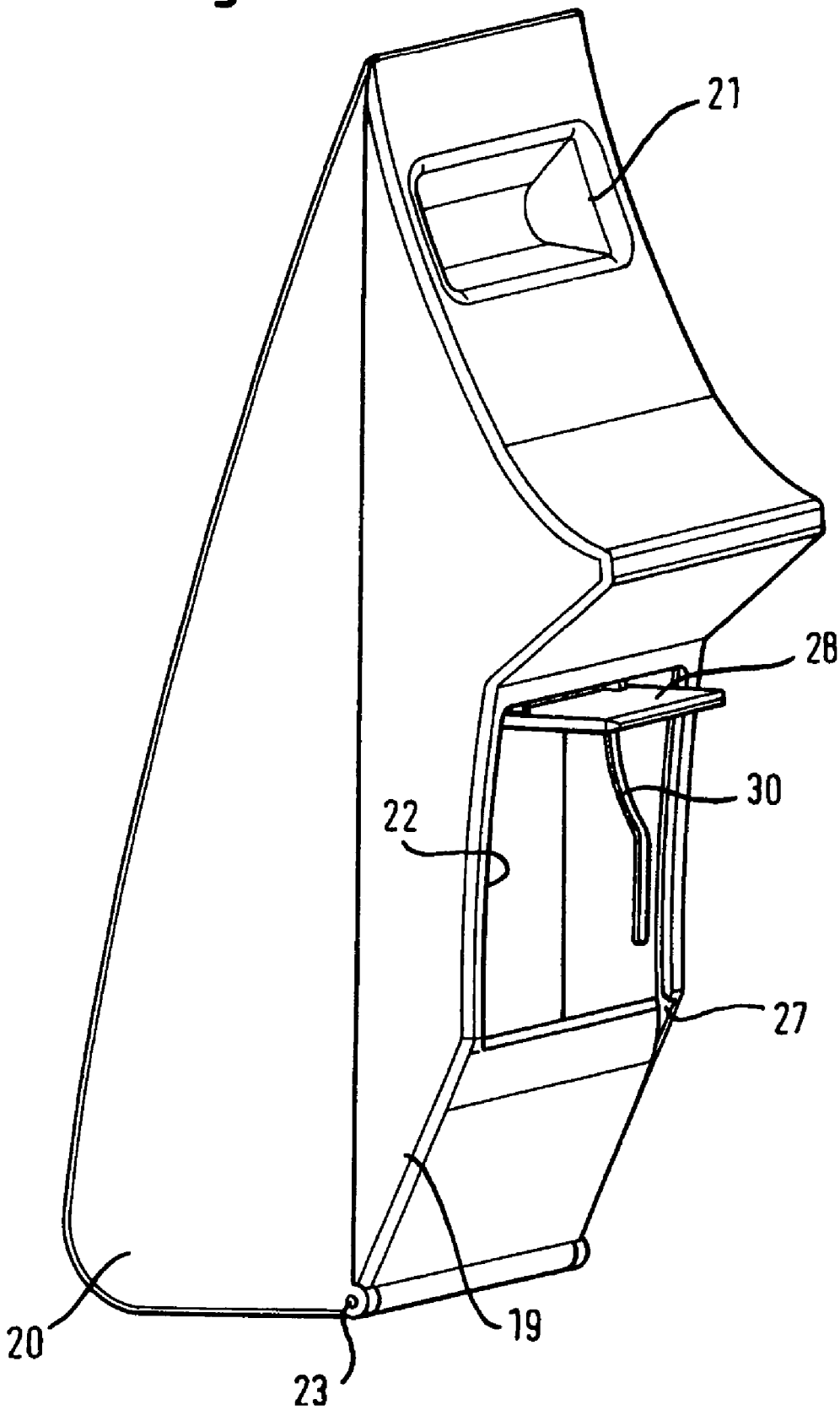
Figure 7:
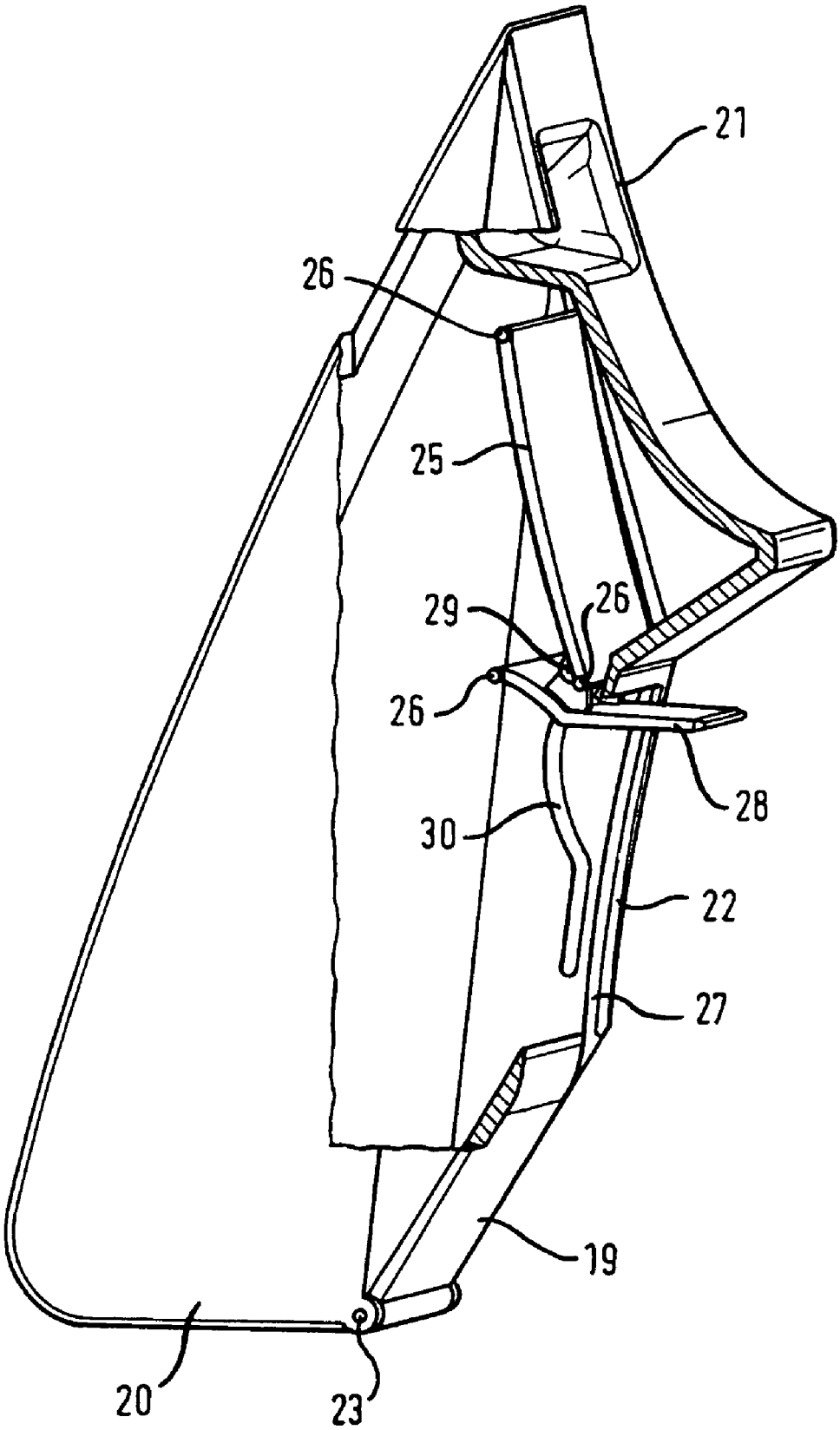
Figure 8:
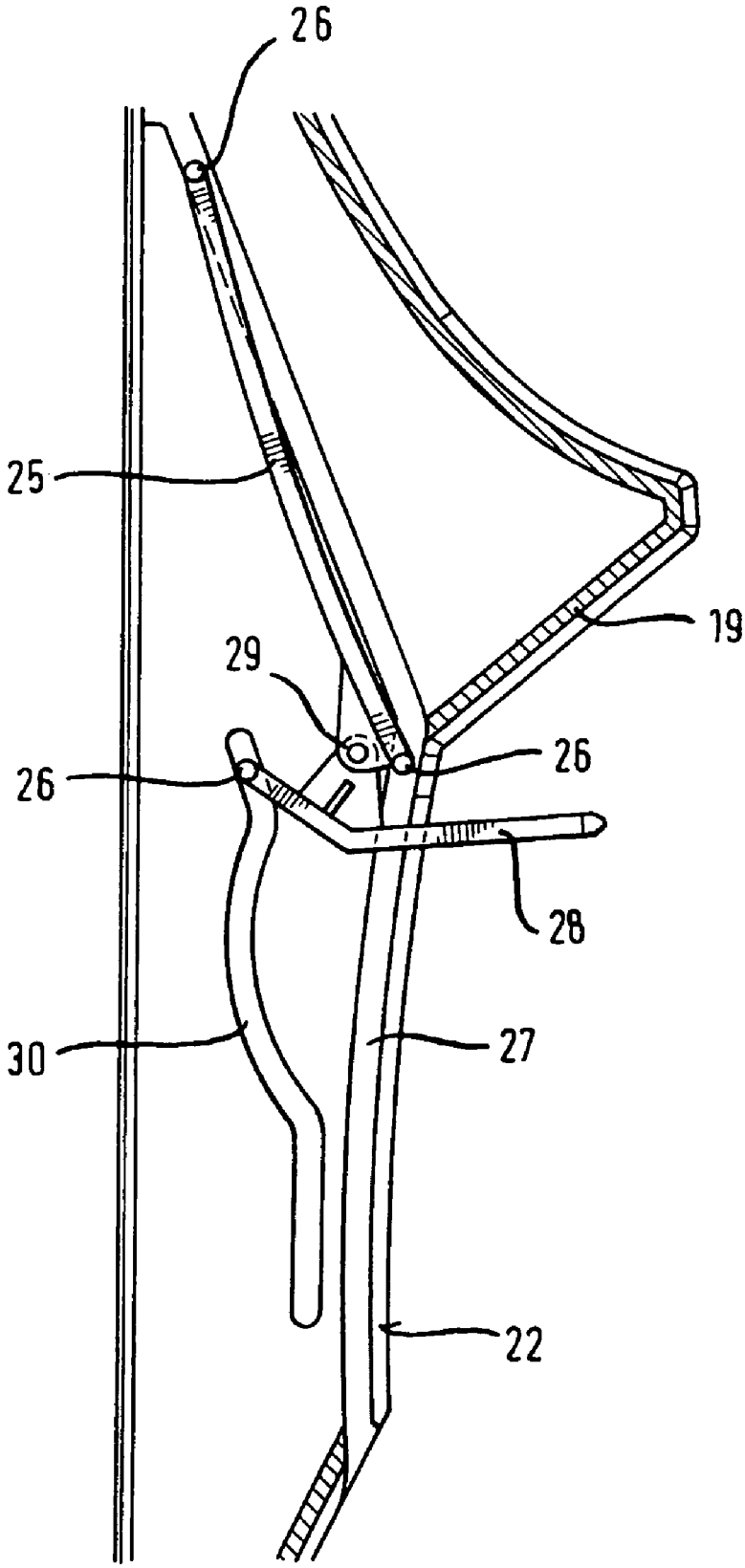
Figure 9:
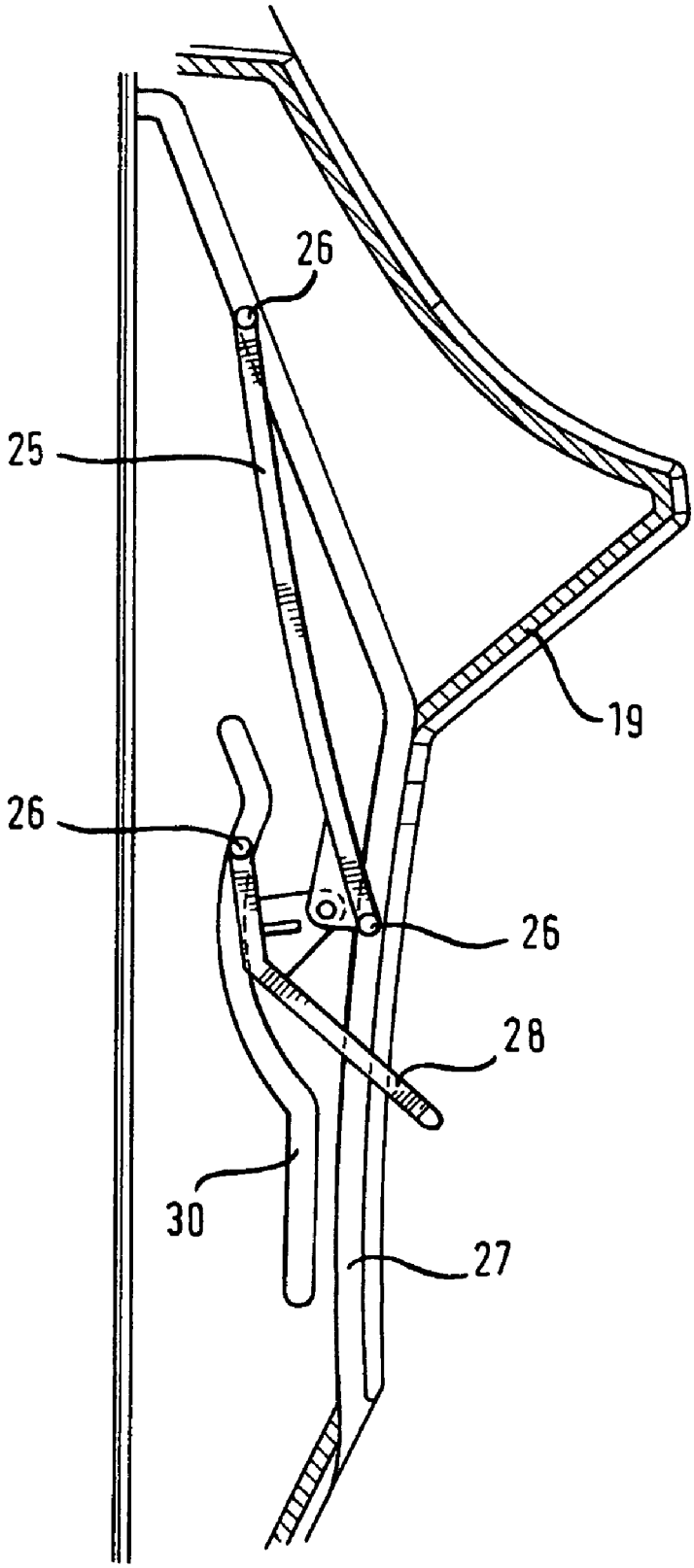
Figure 10:
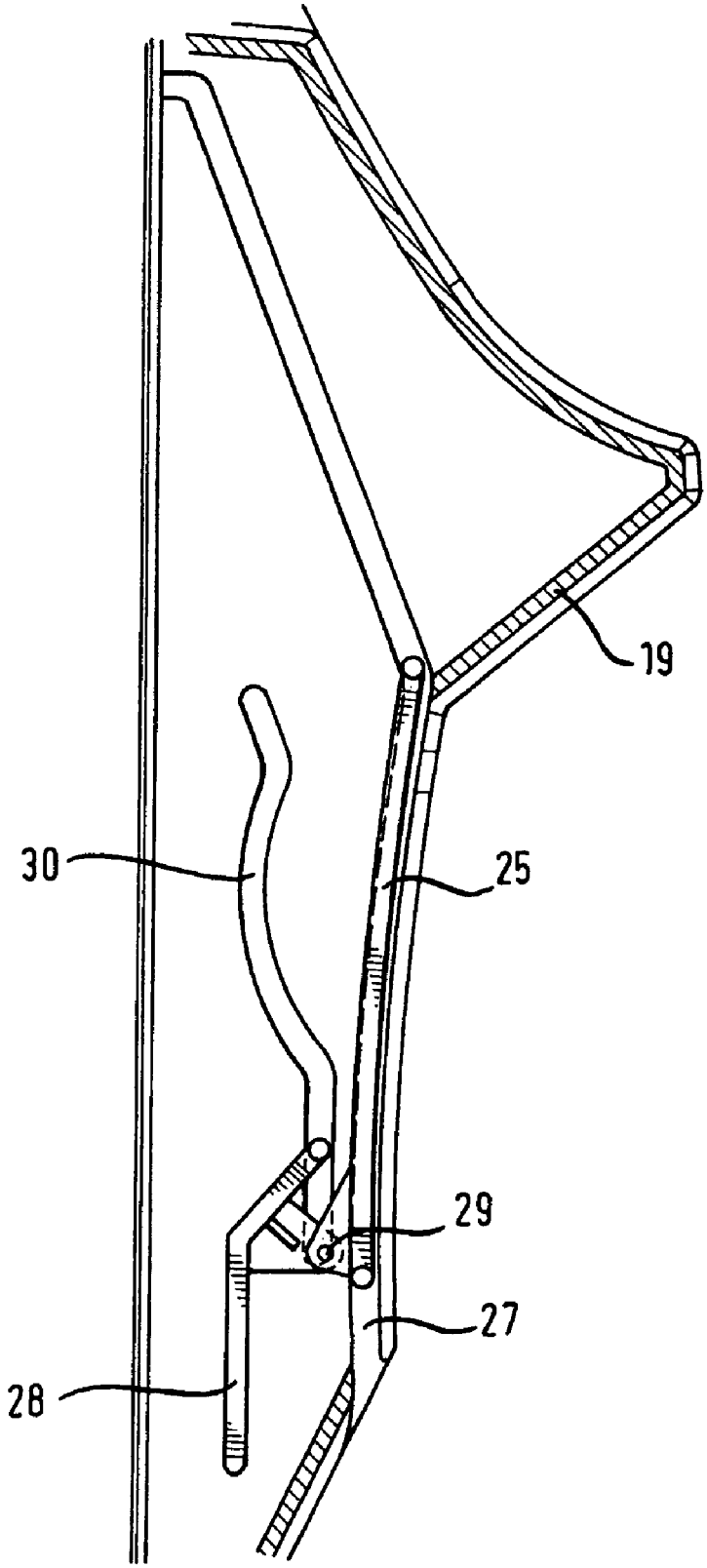
Figure 11:
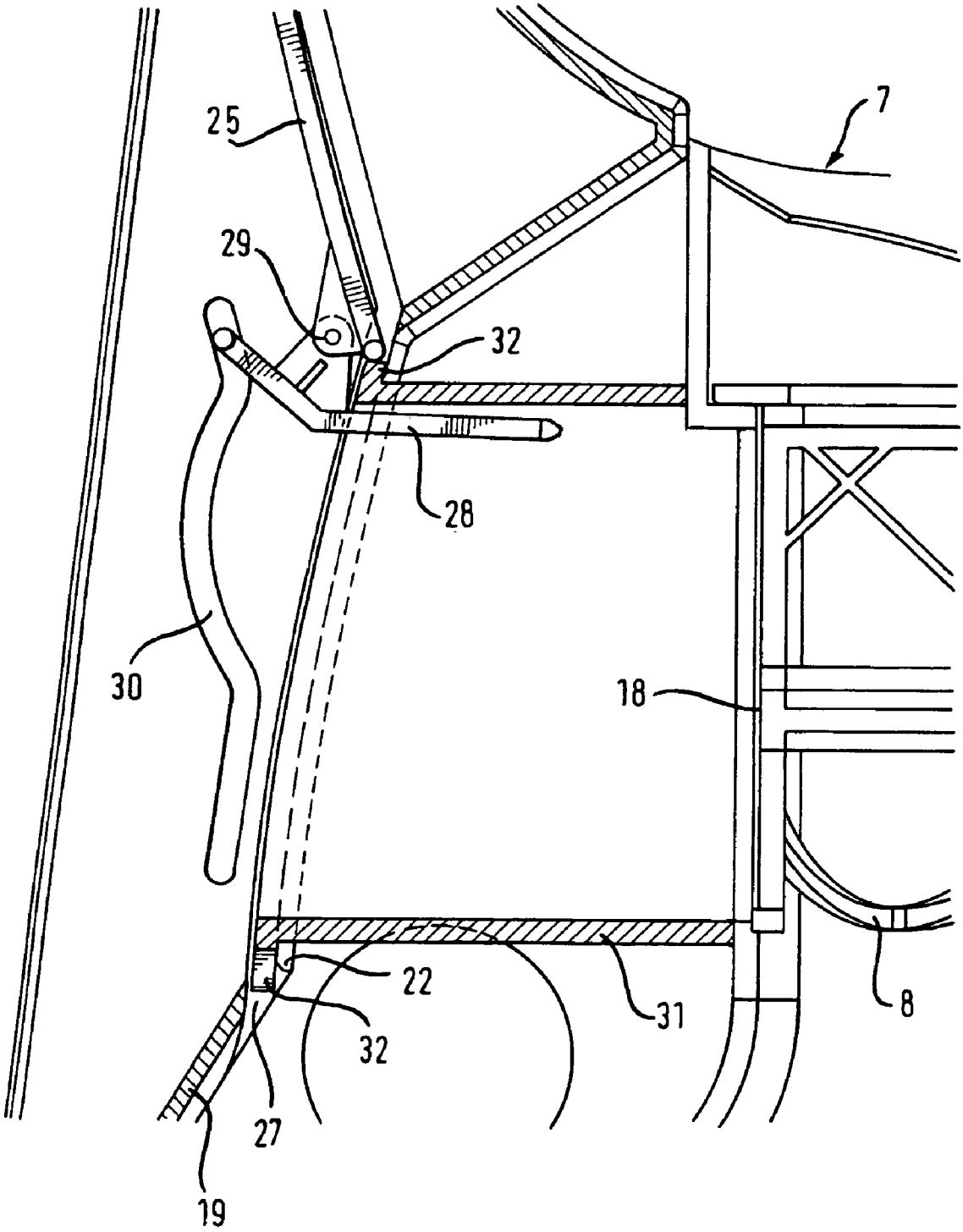

Exemplary embodiments of the invention are explained in the following on the basis of the drawing. Individually, they show:

FIG. 1 a schematic cross-section through a tumble dryer;

FIG. 2 a partial view of an end plate of a tumble dryer, provided with a filter and a scraper and a receptacle to accept scraped-off lint;

FIG. 3 a partial view of an end plate of a tumble dryer as in FIG. 2, but with a receptacle moved out of a latched position;

FIG. 4 and FIG. 5 views of the embodiment of a receptacle represented in FIGS. 2 and 3;

FIG. 6 a view of a different embodiment of the receptacle;

FIG. 7 a partial cutaway view of the receptacle as in FIG. 6;

FIGS. 8, 9 and 10 cross-sectional views of the receptacle as in FIG. 6 with the pusher in different positions;

FIG. 11 a cross-sectional view through a receptacle as in FIGS. 6 and 7, inserted into a tumble dryer.

The respective parts of the tumble dryer in each case bear the same reference number in all Figures.

According to FIG. 1, the device for drying laundry 1 by means of a current of air comprises a drum 2 to accommodate the laundry 1, the drum 2 being capable of rotation around an axis 3, in order to agitate the laundry 1 in the current of air. The current of air is directed out of the drum 2 in a ducting system 4, 5, 6 and redirected into it once more. The ducting system 4, 5, 6 comprises a downward section 4, part of which passes through an end plate 7 for loading of the drum 2, a horizontal section 5 underneath the drum 2 and an upward section 6, through which the current of air reenters the drum 2. The downward section 4 contains a filter 8, which is arranged in the end plate 7, and by means of which the lint 9, which the current of air loosens from the laundry 1, is captured. Using means not represented in FIG. 1, lint 9 thus captured can be scraped off the filter 8, in order to ensure that the filter 8 presents the least possible resistance against the current of air. A heat exchanger 10 is provided for in the horizontal section 5 which follows the downward section 4, in which the steam conveyed in the current of air is cooled down and condensed. By known means not represented in FIG. 1, the condensed water is separated out of the current of air and disposed of. In the upward section 6 which follows the horizontal section 5 are a fan 22, which drives the current of air 2 through the drum 2 and the ducting system 4, 5, 6, and a heating apparatus 12, via which the current of air is warmed once more prior to entering the drum 2. The heat exchanger 10 and the heating apparatus 12 can, if appropriate, belong completely or partially to a recuperative heat transfer system, in particular a heat pump. The end plate 7 forms on one side a support structure for a frontal panel of the device and a frontal support for the drum 2, and on the other side bears a door 13 for closing the drum 2.

FIG. 2 shows the seating of the filter 8 (of which, for the sake of clarity, only a filter support is shown, rather than the actual fine-meshed structure which performs the filtration effect) in the end plate 7 of the tumble dryer. The end plate 7 is here viewed from within the drum 2. Having left the drum 2, the current of air passes into the end plate 7 in the direction of the arrow, thus reaching the filter 8. There, the lint 9 carried along by the current of air is filtered out. The lint 9 is removed by the scraper 15, by movement of the latter from a first end 17 of the filter 8 to a second end 18, driven by a motor 16 and a transmission not shown here. The lint thus scraped off passes into the receptacle 19, 20. When it is full of lint 9, the receptacle 19, 20 can be removed from the end plate 7 and emptied, the user holding it by a handle 21, which is formed in the first part 19 of the receptacle 19, 20.

A receptacle 19, 20 removed from its operating position in the end plate 7 is shown in FIG. 3, which otherwise corresponds to FIG. 2. In this way, the collected lint 9 can be removed relatively simply and conveniently, avoiding the unpleasant task of scraping lint off a filter 8, as hitherto necessary with customary tumble dryers.

FIGS. 4 and 5 show views of the receptacle 19, 20 already illustrated in FIGS. 2 and 3. The receptacle comprises two interconnected shell elements 19, 20, which can be separated from each other, comprising a first shell element 19 and a second shell element 20. The first shell element 19 is formed into a handle 21, by which it can be withdrawn from the end plate 7 (cf. FIGS. 2 and 3), and the first shell element 19 has an aperture 22, through which the receptacle 19, 20 can be filled with lint. The shell elements 19 and 20 are connected with each other on one side by a hinge 23 and on the other by a snap connection 24 with hooks and groove, opening of said snap connection 24 being effected by finger pressure on the part of a user.

FIGS. 6 and 7, referred to jointly here, show a different embodiment of the receptacle 19, 20. Once again the receptacle 19, 20 has two shell elements 19 and 20, which are connected with each other by means of a hinge 23 and—though not in this case visible—a snap connection. Here too, a handle 21 formed in the first shell element 19 is provided for, and the first shell element 19 also incorporates an aperture 22 through which the lint is pushed. This aperture 22 can be closed by means of a pusher 25, which is guided by lugs 26 molded onto first guide tracks 27, when the receptacle 19, 20 is removed from an operating position in the tumble dryer. FIG. 11 subsequently shows how the pusher 25 is moved.

Initially, and with additional allusion to FIGS. 8 through 10, reference is made to the flap 28, which is on one side is connected in movable fashion with pusher 25 via a joint 29 and on the other side is guided by corresponding lugs 26 in second guide tracks 30. When the pusher 25 moves downwards out of the position represented in FIG. 7, the flap 28 follows this movement synchronously. Because of the arrangement of the guide tracks 27 and 30 relative to each other, with the first guide tracks 27 being partially, but in any case in the area of the aperture 22, arranged approximately parallel to a vertical, and a second guide track 30 aligned partially parallel to a first guide track 27, a curved piece being arranged between two subsidiary pieces correspondingly arranged in parallel, then a rotational movement is imparted to the flap 28, in addition to its linear downward movement, by means of which rotational movement it is swung into receptacle 19, 20, having initially been swung out of receptacle 19, 20. It is thus capable of forcing any lint which may be protruding from the aperture 22, back into the receptacle 19, 20. This serves to prevent the pusher 25, upon closure of the aperture 22, cutting off such lint, allowing it to drop into the end plate 7 and clogging it or otherwise impairing its operation. The synchronous movement procedure of the pushers 25 and the flap 28 can be followed in FIGS. 8 thorough 10.

The guide tracks 27 and 30 are embodied as grooves, which are molded in corresponding and mutually parallel surfaces of the first shell elements 19. The movement of the pusher 25 and the flap 28 takes place under the influence of this combination's own weight, without the support of an additional drive mechanism. This does of course not exclude the possibility of such a drive mechanism being added if so required, for example in the form of a spring, which exerts a force on the pusher 25 from above.

From FIG. 11 it can be seen how the receptacle 19, 20 shown in FIGS. 6 through 10 is inserted into end plate 7, and how the pusher 25 is here caused to release the aperture 22. In the end plate 7, a tubular connecting piece 31 is mounted on the second end 18 of the filter 8, which links the filter 8 and the receptacle 19, 20 and through which the scraper 15 (cf. FIG. 2) pushes scraped-off lint into the receptacle 19, 20. On this connecting piece are formed guide strips 32, which engage in the first guide tracks 27, when the receptacle 19, 20 is introduced as intended into the end plate 7. In doing so, they contact the pusher 25 and push it upwards within the receptacle 19, 20, so that the aperture 22 is released. The flap 28 moves upwards synchronously with the pusher 25, at the same time swings out of the receptacle 19, 20, in accordance with the sequence which can be seen in the series FIG. 10 to FIG. 8. In this way the receptacle 19, 20 is prepared for acceptance of the scraped-off lint.

LIST OF REFERENCE NUMERALS

1. Laundry
2. Drum
3. Axis
4. Ducting system, downward section
5. Ducting system, horizontal section
6. Ducting system, upward section
7. end plate
8. Filter
9. Lint
10. Heat exchanger
11. Fan
12. Heating device
13. Door
14. Opening in the end plate
15. scraper
16. Motor
17. First end
18. Second end
19. Receptacle, first shell element
20. Receptacle, second shell element
21. Handle on receptacle
22. Aperture in the receptacle
23. Hinge
24. Snap connection
25. Pusher
26. Lug
27. First guide track
28. Flap
29. Joint
30. Second guide track
31. Connecting piece
Guide strip

The invention claimed is:

1. A device for drying laundry, the device comprising:
a drum receiving the laundry;
a ducting system guiding a current of air, said ducting system having a section downstream of the drum, in which the current of air is directed downwardly;
a filter disposed within the section and for capturing lint carried in the current of air from the drum;
a scraper for scraping lint off the filter; and
a receptacle having an aperture for receiving the lint scraped off the filter, the receptacle including a handle and two interlinked shell elements which can be separated from each other, the shell elements defining a storage volume within the receptacle to accommodate the scraped-off lint, wherein the receptacle has a movable pusher which opens the aperture when the receptacle is located in an operating position to accommodate the scraped-off lint, and which closes the aperture upon the receptacle being moved out of the operating position, and wherein the pusher is guided in first guide tracks, the first guide tracks being molded onto the receptacle.

2. The device according to claim 1, wherein the shell elements are connected by means of a hinge and a snap connection corresponding to the hinge.

3. The device according to claim 1, further comprising an end plate forming a support structure for a frontal panel of the device and supporting a door for closure of the drum, the filter and the receptacle being disposed in the end plate.

4. The device according to claim 1, wherein the receptacle is connected to the filter by means of a snap connection.

5. The device according to claim 1, wherein the first guide tracks are at least in part aligned approximately parallel with a vertical axis.

6. The device according to claim 1, further comprising guide strips connected non-positively with the filter, each of which engages in a first guide track for positioning of the receptacle.

7. The device according to claim 6, wherein the pusher is contacted by the guide strips for release of the aperture, and closes the aperture under its own weight upon the receptacle being moved out of the operating position.

8. The device according to claim 1, further comprising a flap, which is connected synchronously with the pusher in a movable manner, via a joint, and is guided in second guide tracks which are in each case partially parallel to first guide tracks and molded onto the receptacle, the flap being swung out of the receptacle when the pusher releases the aperture, and swung into the receptacle, when the pusher closes the aperture.

9. The device according to claim 1, further comprising a motor driving the scraper.

10. The device according to claim 1, wherein the scraper is moveable.

11. The device according to claim 1, wherein the drum is rotatable about an axis at a given rate of rotation and the scraper is movable along the filter to effect scraping of lint off the filter by the scraper.

12. A device for drying laundry, the device comprising:

a drum receiving the laundry;

an end plate forming a support structure for a front panel of the device and supporting a door for closure of the drum:

a lint filter mounted on the end plate beneath the door;

a ducting system guiding a current of air, said ducting system directing air out a front of the drum and downward through the lint filter;

a lint receptacle that is removably mounted on the end plate, the receptacle having an aperture for receiving lint and a flap that is movably mounted on the receptacle, wherein when the receptacle is mounted on the end plate, the flap moves to an open position which leaves the aperture open, and wherein when the receptacle is removed from the end plate, the flap rotates to a closed position, the rotation of the flap pushing lint adjacent the aperture through the aperture and into the receptacle; and a scraper that is movably mounted on the end plate, wherein the scraper moves across the lint filter to scrape lint on the filter toward the aperture of the receptacle.

13. The device according to claim 12, wherein the flap is guided in guide tracks which are molded onto the receptacle.

14. The device according to claim 12, wherein the receptacle further comprises a movable pusher which moves to an open position to open the aperture when the receptacle is mounted on the end plate and which moves to a closed position to close the aperture when the receptacle is removed from the end plate.

15. The device according to claim 14, wherein the pusher is guided in first guide tracks that are molded onto the receptacle, wherein the flap is guided in second guide tracks that are molded into the receptacle, and wherein the flap is coupled to the pusher.

16. The device according to claim 15, wherein the shape of the second guide tracks and the coupling between the pusher and the flap cause the flap to rotate as the flap moves between the open and closed positions.

17. The device according to claim 16, wherein when the flap is in the closed position, the flap is contained within an interior of the receptacle.

18. The device according to claim 15, wherein a guide strip is located on the end plate, and wherein when the receptacle is mounted on the end plate, the guide strip on the end plate contacts the pusher to move the pusher to the open position.

19. The device according to claim 18, wherein when the receptacle is removed from the end plate, gravity causes the pusher to move into the closed position.

20. The device according to claim 12, wherein when the flap moves between the open position and the closed position, the flap moves vertically as it rotates.

* * * * *